US006734765B2

(12) United States Patent
Kuroda

(10) Patent No.: US 6,734,765 B2
(45) Date of Patent: May 11, 2004

(54) DIELECTRIC FILTER, DIELECTRIC DUPLEXER, AND COMMUNICATIONS EQUIPMENT

(75) Inventor: Katsuhito Kuroda, Matsutou (JP)

(73) Assignee: Murata Manufacturing Co. Ltd. (JP)

( * ) Notice: Subject to any disclaimer, the term of this patent is extended or adjusted under 35 U.S.C. 154(b) by 0 days.

(21) Appl. No.: 10/119,340

(22) Filed: Apr. 9, 2002

(65) Prior Publication Data

US 2002/0145491 A1 Oct. 10, 2002

(30) Foreign Application Priority Data

Apr. 10, 2001 (JP) ..... 2001-111161
Feb. 22, 2002 (JP) ..... 2002-046880

(51) Int. Cl.[7] ..... H01P 1/20
(52) U.S. Cl. ..... 333/202; 333/134; 333/206; 333/207
(58) Field of Search ..... 333/134, 202, 333/206, 207

(56) References Cited

U.S. PATENT DOCUMENTS 5,905,420 A * 5/1999 Tsujiguchi et al. ..... 333/206
6,005,456 A * 12/1999 Matsumoto et al. ..... 333/202
6,163,237 A * 12/2000 Toda et al. ..... 333/206
6,483,405 B1 * 11/2002 Toda et al. ..... 333/206
2001/0043131 A1 11/2001 Toda et al.

FOREIGN PATENT DOCUMENTS

EP 1030400 A1 * 8/2000 ..... H01P/1/205
EP 1067620 A2 * 1/2001 ..... H01P/1/205
GB 2374985 10/2002
JP 08051301 A * 2/1996 ..... H01P/1/205
JP 2000138502 A * 5/2000 ..... H01P/1/20

OTHER PUBLICATIONS

European Search Report dated Dec. 16, 2002.

* cited by examiner

*Primary Examiner*—Robert Pascal
*Assistant Examiner*—Kimberly Glenn
(74) *Attorney, Agent, or Firm*—Dickstein, Shapiro, Morin & Oshinsky, LLP.

(57) ABSTRACT

A dielectric block has opposing open and closed end faces extending between opposing top and bottom surfaces thereof. An outer conductor is formed on an outer surface of the dielectric block including the top and bottom surfaces and the closed end face thereof. A plurality of plated through holes extend from the front to the rear face of the dielectric block, the plated through holes having respective internal conductors formed thereon. The internal conductors are conductively coupled to the outer conductor at the closed end face of the dielectric block. An excitation hole extends from the open to the closed end face of the dielectric block and has an inside electrode formed thereon. The inside electrode is conductively coupled to the outer conductor at the open end face thereof. An input-output electrode extends over the open end face of the dielectric block and the mounting surface and is conductively coupled to the inside electrode. Various structures are built into the dielectric block to the ground current flowing through the outer conductor located on the open end surface of the dielectric block from the inside electrode of the excitation hole to the top and mounting surfaces of the dielectric block.

10 Claims, 8 Drawing Sheets

DIELECTRIC FILTER, DIELECTRIC DUPLEXER, AND COMMUNICATIONS EQUIPMENT

BACKGROUND OF THE INVENTION

1. Field of the Invention

The present invention relates to an integral dielectric filter and dielectric duplexer using a dielectric block and communications equipment provided with the filter and duplexer, which are mounted on mobile communications devices, etc.

2. Description of the Related Art

The construction of a prior art dielectric filter is described with reference to FIGS. 8A to 8C.

A dielectric block 1 in the form of a substantially rectangular solid is provided with the through holes 2*a* to 2*c* on which respective internal conductors 3*a* to 3*c* are formed to define respective resonant cavities. Excitation holes 9 and 10 also extend through the dielectic block 1 and have respective internal electrodes formed thereon. An external conductor 4 is formed on the substantially entire outside surface of the dielectric block 1. Internal-conductor-free portions 33*a* to 33*c* are provided in the through holes 2*a* to 2*c* to define open ends of the resonant cavities. The side surface shown in FIG. 8*c* is referred to hereinafter as the open end surface of the dielectric block (because it is adjacent the conductor-free portion 33*a*–33*c*). The internal conductors of the other end of the resonant cavities are coupled to the external electrode 4 to form short-circuited sides of the resonant cavities. The side surface of the dielectric block 1 shown in FIG. 8*a* will be referred to hereinafter as the closed side surface. Each of the through holes 2*a* to 2*c* is constructed as a stepped hole in which the inner diameter on the open circuited side of the cavities is different from the inner diameter on the side of the short-circuited side thereof.

A pair of external-conductor-free portions 7 and 8 extend from the closed side surface to the bottom or mounting surface of the dielectric block 1 to define input-output electrodes 5 and 6 which are conductivity coupled to one end of the internal electrodes of the excitation holes 9 and 10. The other end of the inside electrode of the excitation holes 9 and 10 is conductivity coupled to the external conductor 4.

An integral dielectric filter using a dielectric block is constructed such that the input-output electrodes 5 and 6 provided with the excitation holes 9 and 10 are electromagnetically coupled to the resonator cavities defined by the internal conductors 3*a* to 3*c*.

However, this filter exhibits the following problems.

FIG. 9 shows the grounding current on the open end surface of the dielectric block. When a signal is input to the dielectric filter, the TEM mode as a basic mode is resonated and propagated. Because of this signal, a ground current flows from each of the internal conductors and the inside electrodes formed in the excitation holes to the external conductor which acts, as a grounding electrode.

The grounding current flowing from the inside electrode of the excitation hole 9 to the external conductor flows from the opening end of the excitation hole 9 toward the mounting (lower) surface and its opposite (upper) surface as shown in FIG. 9.

On the other hand, since the external-conductor-free portions 7 and 8 surrounding the input-output electrodes 5 and 6 extend over the mounting surface, the electromagnetic field distribution becomes asymmetrical on the mounting surface and its opposite surface of the dielectric filter. As a result, TE modes having TE101 mode, having a component of electric field perpendicular to the mounting surface and its opposite surface and revolving when seen from the mounting surface, as a main component are excited. As a result, the attenuation and spurious characteristics around the passband of the dielectric filter are greatly worsened.

SUMMARY OF THE INVENTION

It is an object of the present invention to construct a dielectric filter and dielectric duplexer of a simple construction having excellent spurious characteristics by reducing unnecessary modes except TEM mode as a basic mode and communications equipment provided with the dielectric filter and duplexer.

To this end, the invention comprises:

- a dielectric block having opposing open and closed end faces extending between opposing top and bottom surfaces thereof;
- an outer conductor formed on an outer surface of the dielectric block including the top and bottom surfaces and the closed end face thereof;
- a plurality of plated through holes extending from the front to the rear face of the dielectric block, the plated through holes having respective internal conductors formed thereon, the internal conductors being conductively coupled to the outer conductor at the closed end face of the dielectric block;
- an excitation hole holes extending from the open to the closed end face of the dielectric block and having an inside electrode formed thereon, the inside electrode being conductively coupled to the outer conductor at the open end face thereof;
- an input-output electrode extending over the open end face of the dielectric block and the mounting surface of the dielectric block, the input-output electrode being conductively coupled to the inside electrode; and
- ground current setting means for controlling the ground current flowing through the outer conductor located on the open end surface of the dielectric block from the inside electrode of the excitation hole to the top and mounting surfaces of the dielectric block.

In accordance with one preferred embodiment of the invention, the outer conductor is located on the open end face of the dielectric block and the ground current setting means is an electrode-free portion provided on the open end face at a location between one end of the excitation hole and the top and/or mounting surfaces.

In accordance with another preferred embodiment of the invention, the ground current setting means is the difference in the distance of the excitation hole from the mounting surface at the open end face relative to the distance of the excitation hole from the mounting surfaces at the closed end face, the distances being measured in a direction perpendicular to the mounting surface.

In accordance with another preferred embodiment of the invention, the ground current setting means is a recess formed in the open end face of the dielectric block in the area surrounding the end of the excitation hole which opens at the open end face. In one embodiment, the recess extends at an oblique angle to the mounting surface so as to be deeper at the top surface of the dielectric block than at the mounting surface thereof.

The invention is further directed towards a dielectric duplexer containing the foregoing dielectric filters.

The invention is further directed towards communications equipment containing the foregoing dielectric filters and duplexers.

DESCRIPTION OF THE PREFERRED EMBODIMENTS

Figure 1A:
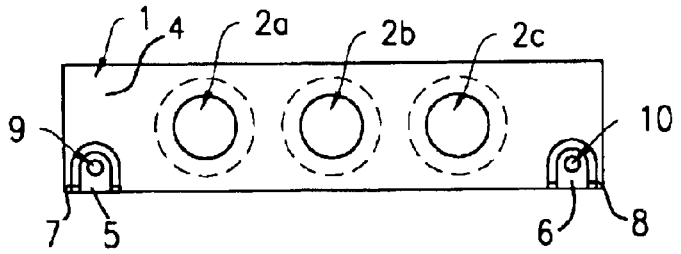
FIG. 1A is a front view of a dielectric resonator in accordance with a first embodiment of the present invention showing the closed end face thereof.
Figure 1B:
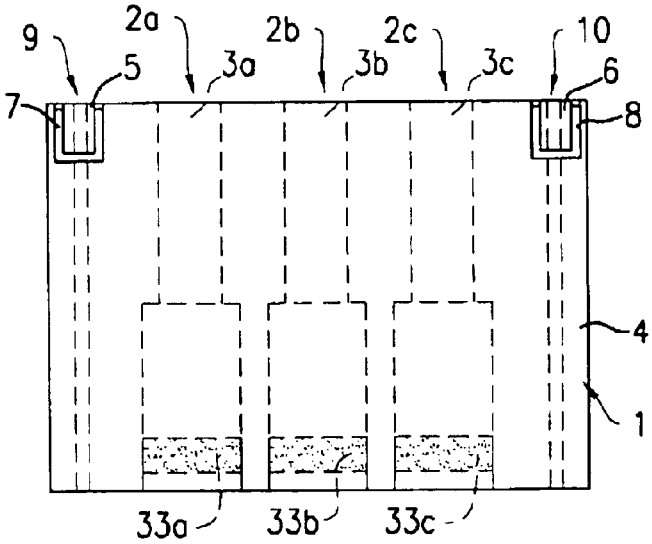
FIG. 1B is a bottom view of the dielectric filter of FIG. 1A showing the mounting surface thereof.
Figure 1C:
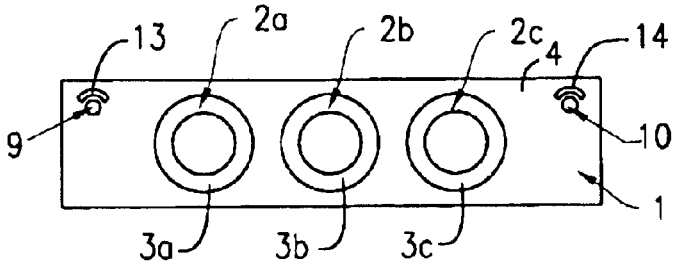
FIG. 1C is a rear view of the dielectric resonator of FIG. 1A showing the open end face thereof.

The construction of a dielectric filter according to a first embodiment of the invention is described with reference to FIGS. 1A, 1B, and 1C.

A dielectric block 1 in the form of a substantially rectangular solid is provided with a plurality of through holes 2*a* to 2*c*, in which respective internal conductors 3*a* to 3*c* are formed to define respective resonant cavities. A pair of excitation holes 9 and 10, in which respective inside electrodes are formed, extend through the dielectric block 1.

An external conductor 4 is formed on the substantially entire outer surface of the dielectric block 1 and is directly coupled to the internal conductors of the plated through holes to form short circuited sides of the resonant cavities. The surface of the dielectric block at which the outer conductor 4 is coupled to inner conductors of the plated through holes (the surface shown in FIG. 1*a*) will be referred to as the closed side surface of the dielectric block.

Internal-conductor-free portions 33*a* to 33*c* are provided in the plated through holes 2*a* to 2*c*, at the opposite ends of the plated through holes to define open ends of the resonant cavities. The front surface of the dielectric block adjacent the conductorless portions (the surface shown in FIG. 1*c*) will be referred to herein as the open end surface. In the disclosed embodiment, each of the plated through holes 2*a* to 2*c* is constructed as a stepped hole in which the inner diameter on the open circuited side of the resonant cavities is different from the inner diameter of the short-circuited side thereof.

External-conductor-free portions 7 and 8 are formed in the outer conductor 4 to extend from the closed end face of the dielectric block to the bottom or mounting surface thereof to define respective electrodes 5 and 6 which are directly coupled to the inside electrodes of one end of the excitation holes 9 and 10, respectively. The other end of the inside electrodes of the excitation holes 9 and 10 is short-circuited to the external conductor 4 at the open end face of the dielectric block as shown in FIG. 1*c*.

An electrode-free portion 13 is formed in the outer conductor 4 on the open end face of the dielectric block at a location close to the mounting surface and in the vicinity of the excitation hole 9. In the same way, an electrode-free portion in 14 is formed the outer conductor 4 at a location close to the mounting surface and in the vicinity of the excitation hole 10.

As described above, since the external-conductor-free portions 7 and 8 around the input-output electrodes 5 and 6 extend over the mounting surface, the electromagnetic fields on the mounting (bottom) surface of the dielectric block and its opposite (upper) become asymmetrical. Therefore, TE mode containing TE101 mode having a component of electric field perpendicular to the mounting surface (and its opposite surface) as a main component is excited.

However, this TE mode is also affected by the grounding current flowing to the open end surface on which the outer conductor is short circuited to the inside electrodes of the excitation holes. The electric field, magnetic field, and grounding current affect one another. For this reason, the electrode-free portions 13 and 14 suppress the asymmetry of the grounding currents on the mounting surface and its opposite surface which is caused by the input-output electrodes 5 and 6. Normally, the electrode-free portions 13 and 14 may be provided such that the grounding current flowing to the external conductor on the mounting surface from the locations where the inside electrodes of the excitation holes are short-circuited to the external conductor. In this way, both the magnetic and electric fields, which induce the above TE mode, are reduced, the excitation of TE mode is suppressed, and spurious characteristics can be improved.

Next, the construction of a dielectric filter according to a second embodiment of the present invention is described with reference to FIGS. 2A, 2B, 2C, and FIG. 3.

A dielectric block 1 in the form of a substantially rectangular solid is provided with the plated through holes 2*a* to 2*f* in which respective internal conductors 3*a* to 3*f* are formed so as to define respective resonant cavities. An external conductor 4 is formed on the substantially the entire outer surface of the dielectric block 1 with one end of each of the internal conductors 3*a* through 3*f* of the through holes 2*a* through 2*f*, respectively, being directly coupled to the outer conductor 4 to form short-circuited ends of the resonant cavities. The short-circuited ends of the resonant cavities terminate at the closed end face of the dielectric block shown in FIG. 2A.

Internal-conductor-free portions 33*a* to 33*f* are provided at the opposite ends of the internal conductors of the through holes 2*a* through 2*f*, respectively, to define open circuit ends of the resonant cavities. The open circuit ends of the resonant cavities terminate at a position adjacent to open end face of the dielectric block 1 shown in FIG. 2C. In this way, each of the internal conductors 3*a* to 3*f* constitutes a dielectric resonator together with the dielectric block 1 and the external conductor 4. In the disclosed embodiment, the plated through holes 2*a* to 2*f* are constructed so as to have a stepped construction in which the inner diameter on the short-circuit side of the resonant cavities being different from the inner diameter on the open circuit side thereof.

Input-output electrodes 16 and 17, separated from the external conductor 4 are formed on the outer surface of the dielectric block 1. The input-output electrodes are defined by external-conductor-free portions 19 and 20 which extend from the mounting surface (the surface shown in FIG. 2B) to the lateral side surfaces of the dielectric block (the left and right side surfaces extending into the plane of the paper in FIG. 2B). An antenna electrode 15, also separated from the external conductor 4, is formed on the dielectric block 1 and is defined by an external-conductor-free portion 18 which extends over the mounting surface to a location on closed end surface of the dielectric block at a location between the plated through holes 2*c* and 2*d*. With this construction, a dielectric duplexer is formed with the portion comprising the plated through holes 2*a* to 2*c* acting as three stage transmission filter and the portion comprising the plated through holes 2*d* to 2*f* acting as a three stage reception filter.

The dielectric duplexer also includes an antenna excitation hole 21 having an inside electrode which is conductivity coupled to an antenna electrode 15 formed on the closed side face and the mounting surface of the dielectric block. The other end of the inside electrode of the antenna excitation hole 21 is short-circuited to the external conductor 4.

In this embodiment, an electrode-free portion 22 is formed in the vicinity of the open end of the antenna excitation hole 21 and at a location close to the mounting surface of the dielectric block 1. Accordingly, the electrode-free portion 22 suppresses the ground current flowing through the external conductor from the end of the inside electrode of the antenna excitation to the mounting surface of the dielectric block.

When constructed in this way, the excitation of TE mode having an electric field component perpendicular to the mounting surface of the dielectric block can be suppressed in the same way as the above-described embodiment.

Figure 2A:
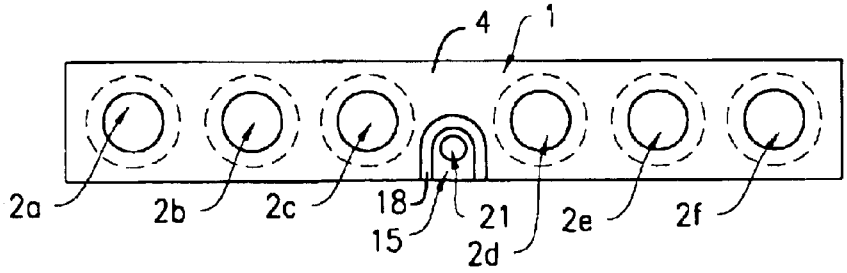
FIG. 2A is a front view of a dielectric duplexer according to a second embodiment of the present invention showing the closed end face thereof.
Figure 2B:
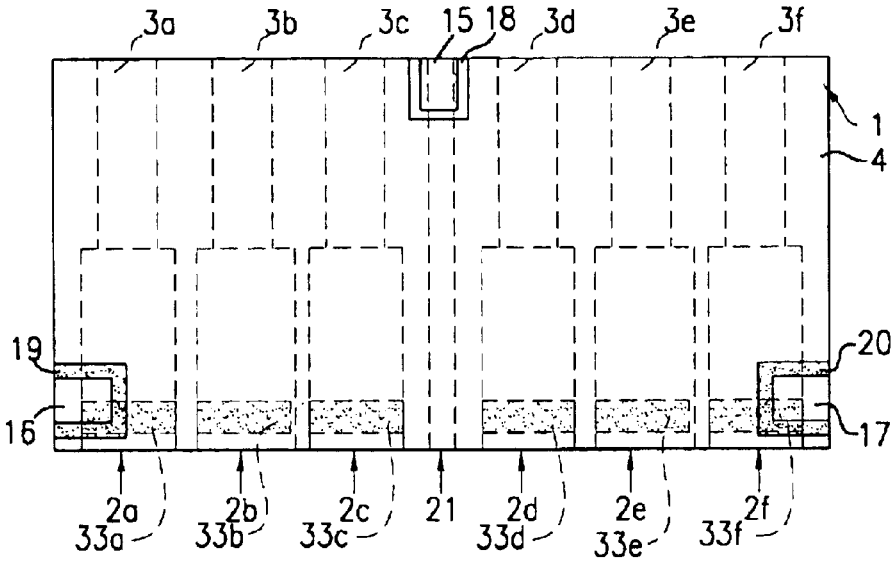
FIG. 2B is a bottom plan view of the dielectric duplexer of FIG. 2A showing the mounting surface thereof.
Figure 2C:
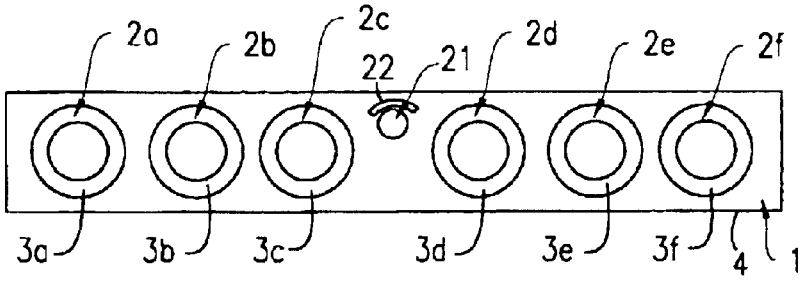
FIG. 2C is a rear view of the dielectric filter of FIG. 2A showing the open end face thereof.
Figure 3:
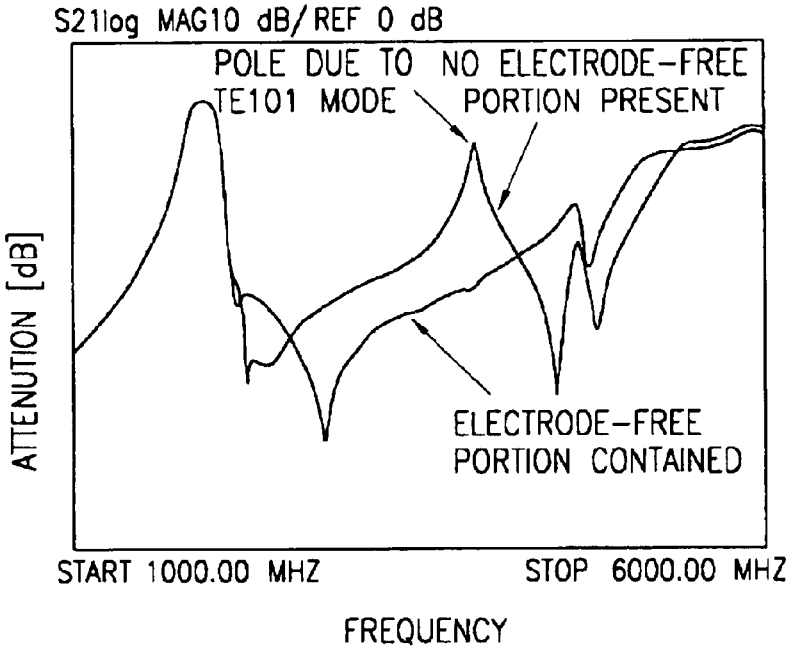
FIG. 3 is a graph showing the pass characteristics of the dielectric duplexer of FIG. 2A.

FIG. 3 shows the pass characteristics of the dielectric duplexer shown in FIGS. 2A to 2C. Because the excitation of TE mode is suppressed as described above, for example, the pole due to TE101 mode disappears as shown in FIG. 3 and the attenuation increases in the cutoff frequency band, and, as a result, spurious characteristics are improved.

Next, the construction of a dielectric duplexer according to a third embodiment of the present invention is described with reference to FIGS. 4A to 4C.

Figure 4A:
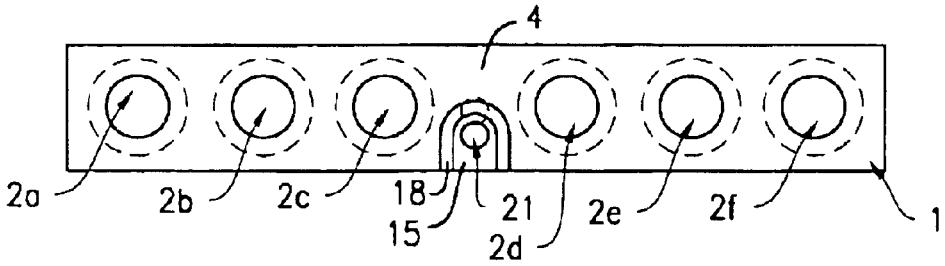
FIGS. 4A and 4B are front and rear views of a dielectric duplexer according to a third embodiment of the present invention and showing the closed and open faces thereof, respectively.
Figure 4B:
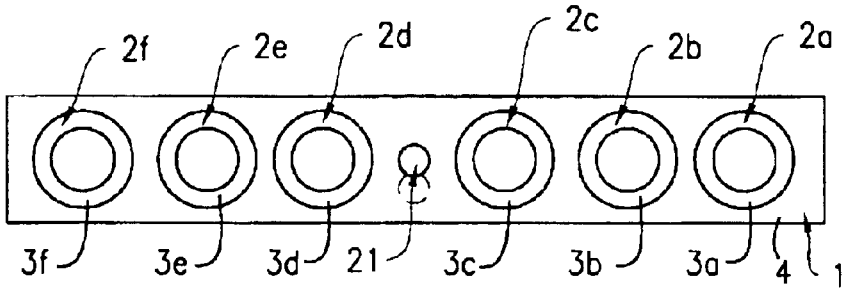
Figure 4C:
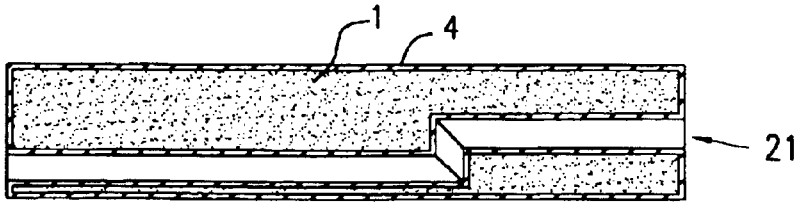
FIG. 4C is a cross-sectional view of the dielectric duplexer of FIG. 4A taken along the antenna hole of the dielectric duplexer.

In the dielectric duplexer shown in FIGS. 4A to 4C, there is no electrode-free portion on the closed end face of the dielectric block. The construction of the plated through holes 2*a* to 2*f*, the internal conductors 3*a* to 3*f*, the external conductor 4, the antenna electrode 15, the input-output electrodes, and the external-conductor-free portion are basically the same as those in the second embodiment. Like the second embodiment, the inside electrode of the antenna excitation hole 21 is short-circuited to the external conductor 4 at the open end face of the dielectric block 1. However, as shown in FIG. 4C, the antenna excitation hole 21 is bent in the middle to form first and second sections of the antenna excitation hole. The first section, which is located adjacent the open end face of the dielectric block, is closer to the mounting surface of the dielectric block than the second section thereof. As a result, the ground current generated in the outer conductor and flowing from the internal conductor to the mounting surface is suppressed.

When constructed in this way, the ground current flowing through the external conductor on the open end face of the dielectric block from the inside electrode of the antenna excitation hole to the mounting surface is suppressed, and, as a result, the excitation of TE mode such as TE101 mode having a component of electric field perpendicular to the mounting surface and its opposite surface, etc., is suppressed.

With this construction, no electrode-free portion is required in the external conductor, and, while the conductor loss is controlled, the grounding current can be suppressed when compared with the dielectric filter and dielectric duplexer shown in the first and second embodiments.

Moreover, in the present embodiment, although the excitation hole is placed at the location shown in FIG. 4C, when the ground current flowing toward the mounting (bottom) surface and its opposite (top) surface is controlled so as to have a fixed amount, the axis may be shifted to other locations in the dielectric block. Furthermore, the excitation hole need not be of a bent (crank) shape, and, for example, may be formed to obliquely pass through the dielectric block relative to the mounting surface.

In the first, second, and third embodiments described above, the open circuited ends of the resonant cavities are constructed by providing an internal-conductor-free portion in the vicinity of the open end face of the dielectric block. However, the open circuited ends of the resonant cavities can be formed by removing the external conductor from the open end face of the dielectric block. In such a case, coupling electrodes are typically provided on the open end face of the dielectric block at a location between neighboring resonant cavities.

Figure 5:
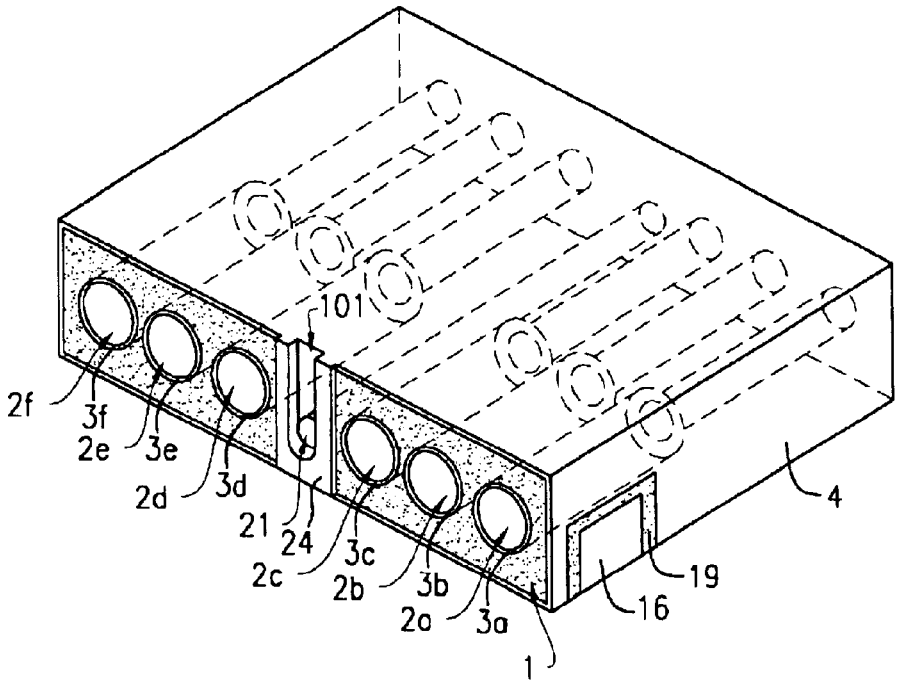
FIG. 5 is a perspective view of a dielectric duplexer according to a fourth embodiment of the present invention.

Next, the construction of a dielectric duplexer according to a fourth embodiment of the present invention is described with reference to FIG. 5.

In this embodiment, a dielectric block 1 in the form of a substantially rectangular solid is provided with the plated through holes 2*a* to 2*f* having respective internal conductors 3*a* to 3*f* formed on the inner surfaces thereof to form respective resonant cavities. An antenna excitation hole 21 having an inside electrode is also provided in the dielectric block 1. An external conductor 4 is formed on the outer surface of the dielectric block 1 on substantially the entire outer surface except the open end surface thereof (the left front surface as viewed in FIG. 5).

An open end electrode 24, which has a fixed width, is formed on the open end face of the dielectric block 1 and is conductivity coupled to the inside electrode of the antenna excitation hole 21 as well as the outer electrode 4 located on the mounting (bottom) and top surfaces of the dielectric block. A recess 101 is formed in the open face of the dielectric block 1 in the area where the antenna excitation hole 21 terminates. The open end electrode 24 is formed only on the surface of the recess 101 and its surrounding. Since the external conductor 4 is not formed on the other portions of the open end face of the dielectric block, the internal conductors 3*a* to 3*f* of the plated through holes 2*a* to 2*f* are separated from the external conductor 4 and constitute the open circuited ends of the resonant cavities.

As in the prior embodiments, the ends of the internal conductors located adjacent the closed end surface of the dielectric block (the right, rear face as viewed in FIG. 5) are directly conductively coupled to the external conductor 4. An antenna electrode (not shown in the drawing) is formed on the closed end face of the dielectric block and is conductively coupled to the inner electrode of the antenna excitation hole 21. The antenna electrode extends over the mounting surface of the dielectric block to the closed end face thereof. As in the embodiment of FIG. 4, the antenna electrode is separated from the external conductor 4 due by an external-conductor-free portion which also extends from the mounting surface to the closed end face of the dielectric block.

An input-output electrode 16, defined by an external-conductor-free portion 19, extends from the lateral side end surface of the dielectric block 1 (the lower right end surface in Figure) to the mounting surface thereof. Moreover, although not illustrated in the drawing, a second input-output electrode extends from the left lateral side surface of the dielectric block 1 to the mounting surface thereof.

The plated through holes 2*a* to 2*c* define a three stage resonator which functions as a transmission side filter while the plated through holes 2*d* to 2*f* define a three-stage resonator which functions as a reception side filter.

In this embodiment, the distance that the ground current flows from the inside electrode of the antenna excitation hole 21 to the top surface of the dielectric block is substantially the same as it would be if the recess 101 was not formed in the open side face of the dielectric block. In contrast, the distance that the ground current flows from the inside electrode of the antenna excitation hole 21 to the mounting surface is different than it would be in the absence of the recess because the ground current must flow through the side walls of the recess (the walls extending perpendicular to the open end face of the dielectric block). As a result, it is possible to vary the density of the ground current flowing from the inner electrode of the antenna excitation hole to the top surface and from the inner electrode of the antenna excitation hole to the mounting surface. In this way, the excitation of TE mode having a component of electric field perpendicular to the top and mounting surfaces can be suppressed and a dielectric duplexer having excellent spurious characteristics can be constructed.

Furthermore, when the recess is formed by cutting a block shaped section of the dielectric block, the cutting operation is easy and the outer shape can be easily formed to realize desired characteristics. Furthermore, when the dimensions of the concave portion is set in advance, dielectric duplexers having excellent spurious characteristics can be easily mass-produced by using molding dies.

Next, the construction of a dielectric duplexer according to a fifth embodiment of the present invention is described with reference to FIG. 6.

Figure 6:
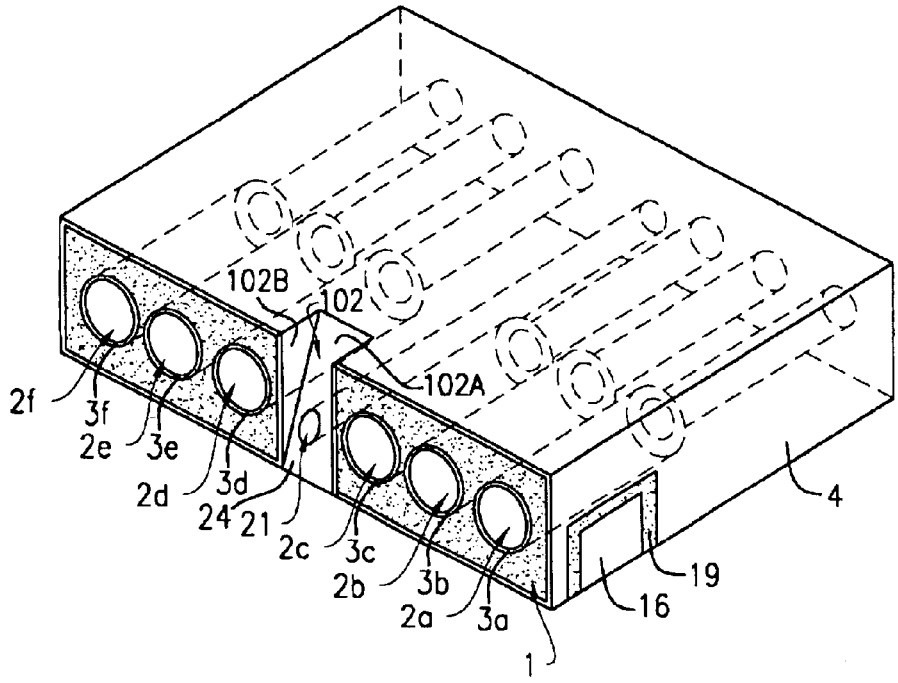
FIG. 6 is a perspective view of a dielectric duplexer according to a fifth embodiment of the present invention.

In the dielectric duplexer shown in FIG. 6, a recess 102, which extends obliquely from the mounting surface to the top surface of the dielectric block 1, is provided in the open end face of the dielectric block. The recess 102 preferably has a fixed width as measured in the direction of arrangement of the plated through holes (i.e. the direction parallel to the mounting surfac). An open end electrode 24 is formed in the recess 102. It is preferably not formed on any other part of the open end face.

The construction of the other elements of this embodiment is the same as the corresponding elements in the dielectric duplexer shown in the fourth embodiment.

As in the fourth embodiment, the density of the ground current flowing from the inner conductor of the antenna excitation hole to the top surface of the dielectric block is less than that of the ground current flowing from the inner conductor of the antenna excitation hole to the mounting surface. This is because the ground current flowing to the top surface passes through both the bottom face 102A and the side walls 102B of the recess 102, thereby reducing the density of the current flow. In contrast, most of the ground current flowing to the mounting surface passes through the bottom face 102A of the recess only. In this way, the ground current flowing from the inside electrode of the antenna excitation hole 21 to the mounting surface and the top surface can be controlled by changing the shape of the concave portion 102. As a result, the excitation of spurious modes such as TE101 mode, etc., is controlled and unnecessary coupling can be prevented by controlling the electric field between the mounting surface and the top surface. As a result, the spurious characteristics can be improved.

Because the recess has a block like form, it is easy to produce either by cutting the dielectric block or forming the block in a mold. In both cases, it is each to control the shape of the recess to ensure that the dielectric resonator exhibits the desired characteristics.

In the fourth and fifth embodiments the open circuited ends of the resonant cavities are formed by not providing the external conductor on the open end face of the dielectric block 1. However, the open circuited ends of the resonant cavities can be formed by plating the open end face of the dielectric block and providing internal-conductor-free portions on the inside of the plated through holes as in the first through third embodiments.

Furthermore, in the second to fifth embodiments, although the dielectric duplexers are illustrated, dielectric filters may be constructed in the same way.

Next, the construction of communications equipment according to a preferred embodiment of the present invention is described with reference to FIG. 7.

Figure 7:
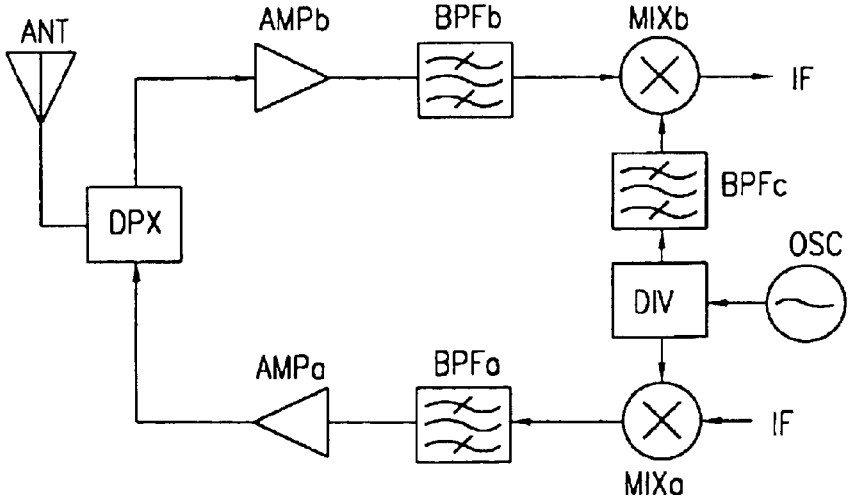
FIG. 7 is a block diagram of communications equipment according the present invention.
Figure 8A:
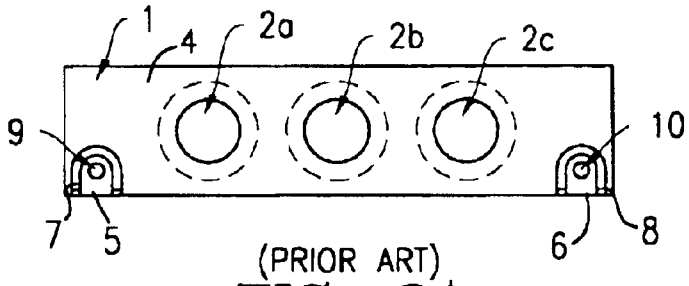
(PRIOR ART) FIG. 8A
FIG. 8A is a front view of a dielectric resonator in accordance with the prior art and showing the closed end face thereof.
Figure 8B:
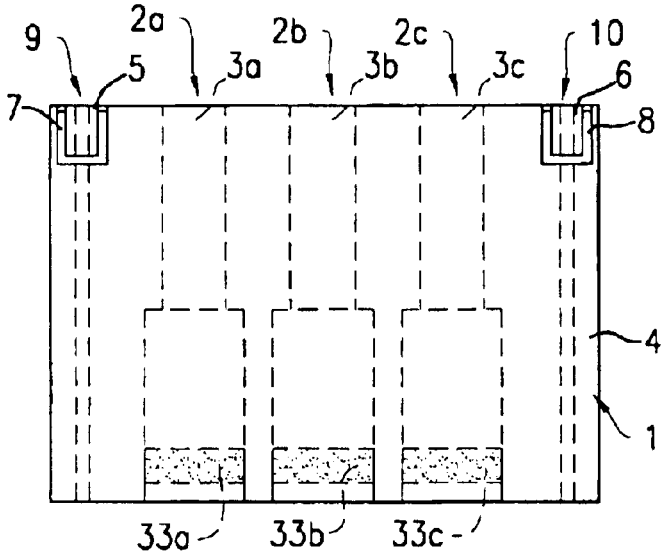
(PRIOR ART) FIG. 8B
FIG. 8B is a bottom view of the dielectric filter of FIG. 8A showing the mounting surface thereof.
Figure 8C:
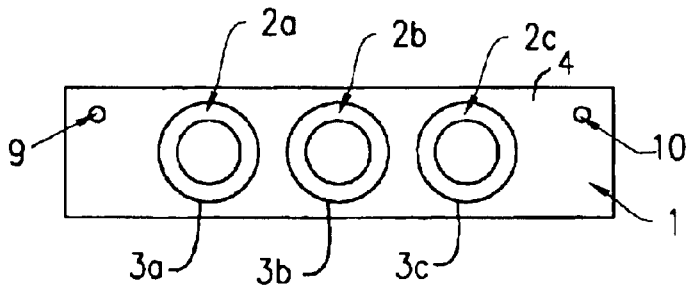
(PRIOR ART) FIG. 8C
FIG. 8C is a rear view of the dielectric resonator of FIG. 8A showing the open end face thereof.
Figure 9:
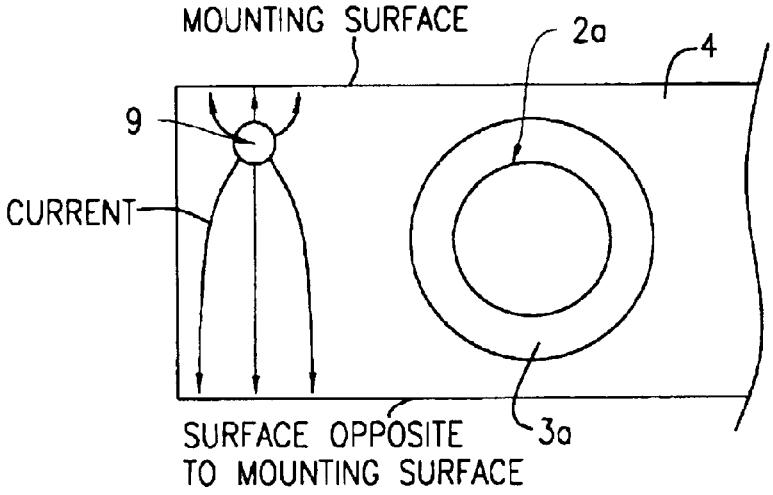
(PRIOR ART) FIG. 9
FIG. 9 shows a grounding current on an open end surface of the dielectric resonator of FIG. 8A where an excitation hole of a dielectric filter is short-circuited to an external conductor.

In FIG. 7, a transmission-reception antenna ANT, a duplexer DPX, bandpass filters BPFa, BPFb, and BPFc, amplifiers AMPa and AMPb, mixers MIXa and MIXb, an oscillator OSC, and a divider (synthesizer) DIV are shown. A frequency signal output from the divider DIV is modulated by using an IF signal at the mixer MIXa, the bandpass filter BPFa passes only the transmission-frequency band, and the amplifier AMPa power amplifies the transmission-frequency band to transmit it from the antenna ANT through the duplexer DPX. The amplifier AMPb amplifies a signal output from the duplexer DPX, and the bandpass filter BPFb passes only the reception frequency band out of the signal output from the amplifier AMPb. The mixer MIXb mixes a frequency signal output from the bandpass filter BPFc and the reception signal to output an intermediate frequency signal IF.

In the filters shown in FIG. 7, the dielectric filter having the construction shown in FIG. 1 can be used, and, in the duplexer, the dielectric duplexers having the construction shown in FIG. 2 and FIGS. 4 to 6 can be used. In this way, communications equipment having a simple construction as a whole and having excellent transmission characteristics can be constructed.

According to the present invention, an input-output electrode coupled to the inner electrode of an excitation hole extends from ground current setting means for controlling a ground current flowing from the inside electrode of the excitation hole toward the mounting surface of the dielectric block relative to a ground current flowing from the inside electrode of the excitation hole toward the top surface of the dielectric block are provided. Preferrably As a result, a dielectric filter having excellent spurious characteristics can be constructed.

Furthermore, according to the present invention, a dielectric filter having excellent spurious characteristics can be constructed such that a grounding current flowing from the inside electrode of an excitation hole to the mounting and top surfaces of a dielectric block is controlled by providing electrode-free portions on the other opening surface opposite to one opening surface of the excitation hole where the input-output electrodes are formed and that, as a result, a component of electric field perpendicular to the mounting surface and its opposite surface is controlled and, accordingly, spurious modes due to this electric field is suppressed.

Furthermore, according to the present invention, a dielectric filter having excellent spurious characteristics can be constructed such that a grounding current flowing to an external conductor on a mounting surface and its opposite surface is controlled by making the opening position of an excitation hole on the other opening surface opposite to one opening surface of the excitation hole, where input-output electrodes are formed, farther from the mounting surface than the opening position on the one opening surface and that, as a result, a component of electric field perpendicular to the mounting surface and its opposite surface is controlled and, accordingly, spurious modes due to the component of electric field is suppressed. Furthermore, when molding dies are designed in advance so as to be able to obtain desired characteristics without processing the external conductor, a dielectric filter can be easily constructed.

Furthermore, according to the present invention, a dielectric filter can be easily constructed without using internal-conductor-formed holes of a complicated shape such that a concave portion extending to the surface, opposite to the mounting surface, from the opening end of an excitation hole is formed so as to have a width containing the opening end on the other opening surface opposite to one opening surface of the excitation hole where the input-output electrodes are formed.

Furthermore, according to the present invention, a dielectric filter can be easily constructed without using a complicated concave portion such that a concave portion deepened from the mounting surface to its opposite surface is formed so as to have a width containing an opening end of an excitation hole on the other opening surface opposite to one opening surface of the excitation hole where the input-output electrodes are formed. Furthermore, a dielectric filter, the physical change of which can be easily made from the outside and fine adjustment of which is easy, can be constructed.

Furthermore, according to the present invention, a dielectric duplexer of a simple construction having excellent spurious characteristics can be easily constructed by providing the above dielectric filter.

Furthermore, according to the present invention, communications equipment having excellent communications characteristics can be easily constructed by providing the above dielectric filter or the above dielectric duplexer.

What is claimed is:

1. A dielectric filter comprising:

a dielectric block having opposing open and closed end faces extending between opposing top and mounting surfaces thereof;

an outer conductor formed on an outer surface of the dielectric block including the top and mounting surfaces and the closed end face thereof and a part of the open end face;

a plurality of plated through holes extending from the open end face to the closed end face of the dielectric block, the plated through holes having respective internal conductors formed thereon, the internal conductors being conductively coupled to the outer conductor at the closed end face of the dielectric block;

an excitation hole extending from the open end face to the closed end face of the dielectric block and having an inside electrode formed thereon, the inside electrode being conductively coupled to the outer conductor at the open end face thereof;

an input-output electrode extending over the closed end face of the dielectric block and the mounting surface of the dielectric block, the input-output electrode being conductively coupled to the inside electrode of the excitation hole; and ground current setting means for controlling the ground current flowing through the outer conductor located on the open end surface of the dielectric block from the inside electrode of the excitation hole to the top and mounting surfaces of the dielectric block, the ground current setting means being an electrode-free portion provided on the open end face at a location between one end of the excitation hole and the top and/or mounting surfaces.

2. A dielectric duplexer containing a dielectric filter as claimed in claim 1.

3. Communications equipment containing a dielectric duplexer as claimed in claim 2.

4. Communications equipment containing a dielectric filter as claimed in claim 1.

5. A dielectric filter comprising:

a dielectric block having opposing open and closed end faces extending between opposing top and mounting surfaces thereof;

an outer conductor formed on an outer surface of the dielectric block including the top and mounting surfaces and the closed end face thereof and a part of the open end face;

a plurality of plated through holes extending from the open end face to the closed end face of the dielectric block, the plated through holes having respective internal conductors formed thereon, the internal conductors being conductively coupled to the outer conductor at the closed end face of the dielectric block;

an excitation hole extending from the open end face to the closed end face of the dielectric block and having an inside electrode formed thereon, the inside electrode being conductively coupled to the outer conductor at the open end face thereof;

an input-output electrode extending over the close end face of the dielectric block and the mounting surface of the dielectric block, the input-output electrode being conductively coupled to the inside electrode of the excitation hole; and ground current setting means for controlling the ground current flowing through the outer conductor located on the open end surface of the dielectric block from the inside electrode of the excitation hole to the top and mounting surfaces of the dielectric block, wherein the ground current setting means is the difference in the distance of the excitation hole from the mounting surface at the open end face relative to the distance of the excitation hole from the mounting surfaces at the closed end face, the distances being measured in a direction perpendicular to the mounting surface.

6. A dielectric filter as claimed in claim 5 in which the ground current setting means comprises the excitation hole comprising two segments which are axially offset from one another whereby the distance of the segment of the excitation hole from the mounting surface at the open end face relative to the distance of the segment of the excitation hole from the mounting surfaces at the closed end face are different.

7. A dielectric duplexer containing a dielectric filter as claimed in claim 6.

8. Communications equipment containing a dielectric duplexer as claimed in claim 7.

9. Communications equipment containing a dielectric filter as claimed in claim 6.

10. A dielectric filter comprising:

a dielectric block having opposing open and closed end faces extending between opposing top and mounting surfaces thereof;

an outer conductor formed on an outer surface of the dielectric block including the top and mounting surfaces and the closed end face thereof and a part of the open end face;

a plurality of plated through holes extending from the open end face to the closed end face of the dielectric block, the plated through holes having respective internal conductors formed thereon, the internal conductors being conductively coupled to the outer conductor at the closed end face of the dielectric block;

an excitation hole extending from the open end face to the closed end face of the dielectric block and having an inside electrode formed thereon, the inside electrode being conductively coupled to the outer conductor at the open end face thereof;

an input-output electrode extending over the closed end face of the dielectric block and the mounting surface of the dielectric block, the input-output electrode being conductively coupled to the inside electrode of the excitation hole; and ground current setting means for controlling the ground current flowing through the outer conductor located on the open end surface of the dialectric block from the inside electrode of the excitation hole to the top and mounting surfaces of the dielectric block, wherein the ground current setting means is a recess formed in the open end face of the dielectric block in the area surrounding the end of the excitation hole at the open end face wherein the recess extends at an oblique angle to the mounting surface so as to be deeper at the top surface of the dielectric block than at the mounting surface thereof.

* * * * *